United States Patent [19]

Robinson

[11] 4,060,866

[45] Dec. 6, 1977

[54] PNEUMATIC AQUATIC DEVICE

[76] Inventor: Walter L. Robinson, P.O. Box 642, Fort Bragg, N.C. 28302

[21] Appl. No.: 733,531

[22] Filed: Oct. 18, 1976

Related U.S. Application Data

[63] Continuation-in-part of Ser. No. 461,637, April 17, 1974.

[51] Int. Cl.[2] ..... A63C 15/02

[52] U.S. Cl. ..... 9/310 D

[58] Field of Search ..... 9/310 R, 310 D, 310 C, 9/310 F, 2 A, 11 A, 13; 114/292; 272/1 B

[56] References Cited

U.S. PATENT DOCUMENTS

| | | | |
|---|---|---|---|
| 1,628,368 | 5/1927 | Lease | 9/310 D |
| 1,834,424 | 12/1931 | Rohrmann et al. | 9/310 D |
| 2,052,240 | 8/1936 | Min | 9/310 D |
| 2,694,209 | 11/1954 | Lippincott | 9/310 D |
| 2,816,299 | 12/1957 | Holladay | 9/310 F |
| 2,893,021 | 7/1959 | Lundborg | 9/310 D |

FOREIGN PATENT DOCUMENTS

| | | | |
|---|---|---|---|
| 676,995 | 11/1964 | Italy | 9/310 D |

*Primary Examiner*—Trygve M. Blix
*Assistant Examiner*—Stuart M. Goldstein
*Attorney, Agent, or Firm*—Stefan M. Stein; Robert F. Frijouf

[57] ABSTRACT

An inflatable aquatic device is disclosed comprising in combination plural aquatic members each having a plurality of flexible gas chambers for containing a gas and providing buoyancy. Each of the plural aquatic members includes a rigid frame having a plate region and a plurality of supports extending relative to the plate region. A system is provided for securing the rigid frame to the flexible gas chambers establishing plural substantially rigid aquatic members. Connectors interconnect the plural aquatic members to allow only limited relative movement therebetween. The invention may include a fabric material adapted to encompass the flexible gas chamber means having a plurality of fabric apertures for receiving the plurality of supports extending from the plate regions. The supports may include plural telescoping tubing members extending from the plate region to enable the pneumatic device to be stored in a relatively small area. The aquatic device may be fashioned as a pair of pontoon-like elements with the plate region adapted to receive the operator's feet. The invention may include a pair of paddles specifically configured for use by the operator in the standing position for directional control and locomotion.

12 Claims, 12 Drawing Figures

FIG. 1
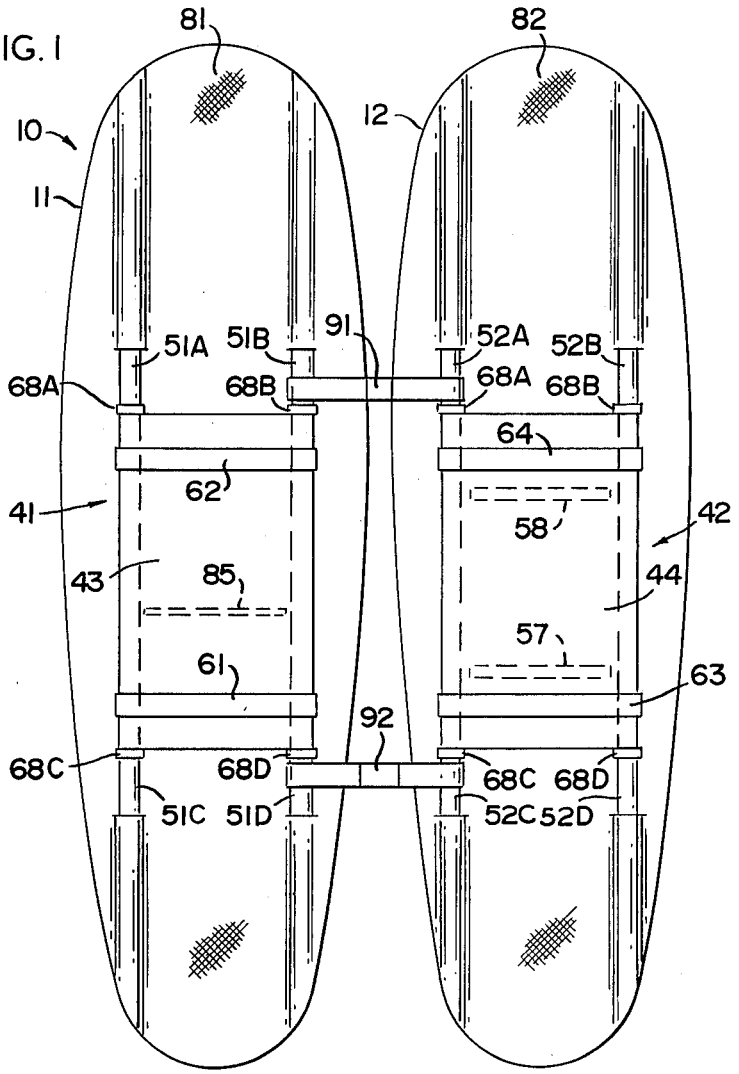
FIG. 3
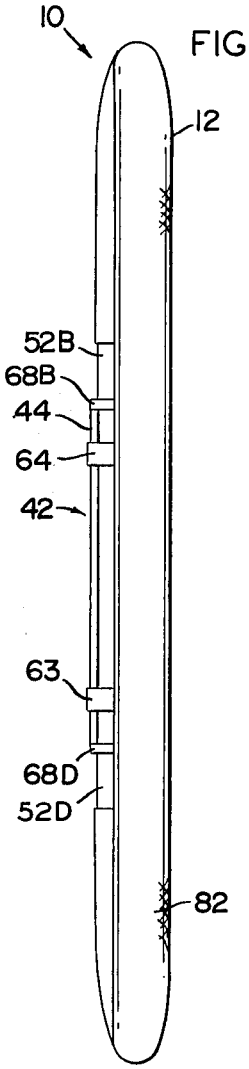
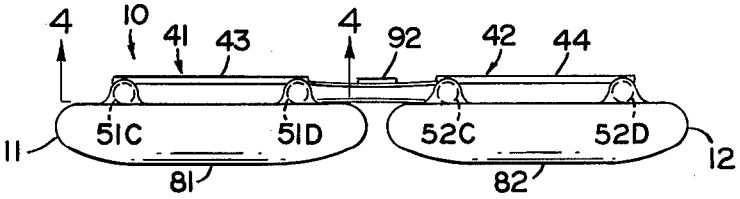
FIG. 2
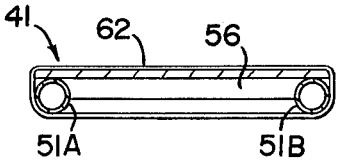
FIG. 5
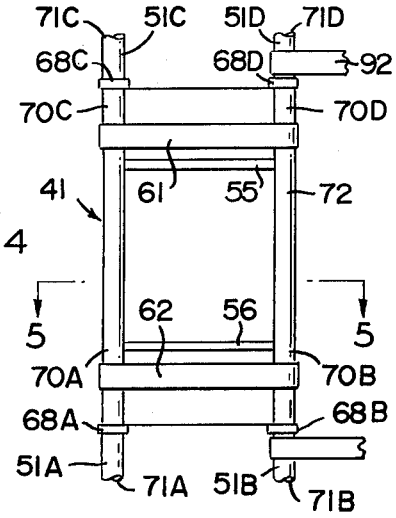
FIG. 4

FIG. 6
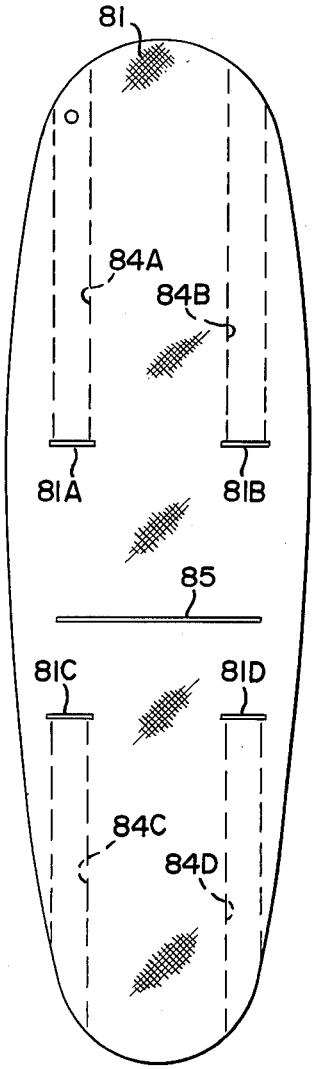
FIG. 7
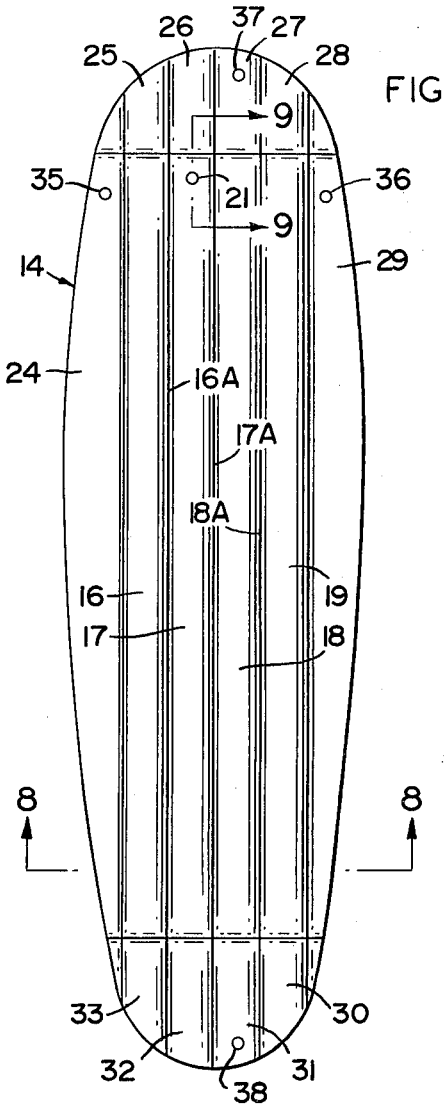
FIG. 8
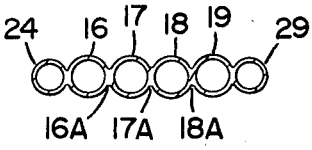
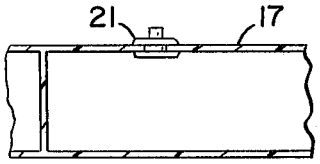
FIG. 9
FIG. 11
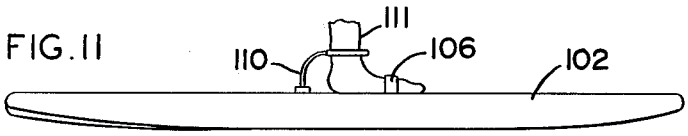
FIG. 10
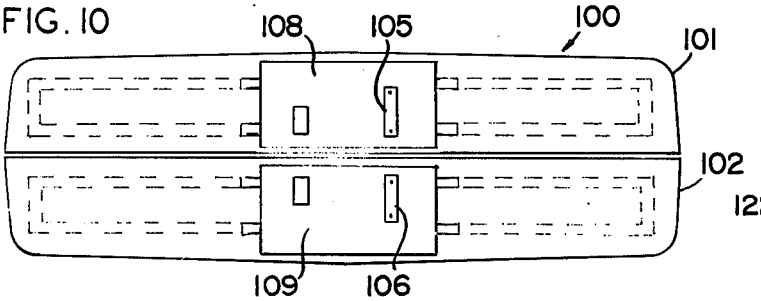
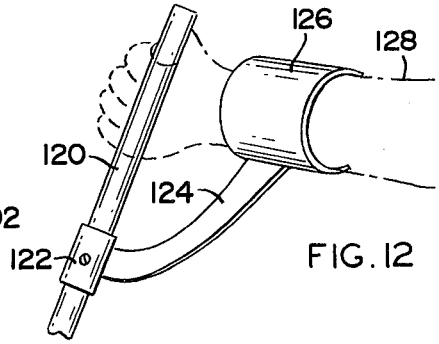
FIG. 12

PNEUMATIC AQUATIC DEVICE

CROSS REFERENCE TO RELATED APPLICATION

This is a continuation-in-part of application Ser. No. 461,637 filed Apr. 17, 1974.

BACKGROUND OF THE INVENTION

1. Field of the Invention

This invention relates to an inflatable aquatic device comprising a pair of pontoon-like elements each configured to accommodate and receive the operator's feet and a pair of paddles specifically configured for use in propelling the operator over a liquid such as water, while the operator is in either the standing or sitting position.

2. Description of the Prior Art

A number of prior art devices are presently known which are primarily designed to support the human body in water. Generally, these devices can be classified into categories which include swimming aids, recreational devices such as rafts or small single occupant propulsion devices such as floats.

The swimming aid and recreational type float devices are usually inflatable or alternately made of buoyant, lightweight material. Both of these types of devices, however, suffer from the problem of being relatively flimsy and generally inefficient in operation. In addition, these conventional devices are generally intended for limited use and are more often particularly designed to maintain the body afloat rather than increase the efficiency in traveling through water.

Since modern day society has provided more free, recreational time to the average individual, various apparatus have been designed and made commercially available to aid in one's pleasure of this increased recreational activity. This is particularly true in the area of water sports. A primary concern, however, is providing these various apparati on a low cost basis while making available to the public, devices which are simple and efficient to operate and maintain at a reasonable cost. While all of these factors have generally been kept in mind, conventional recreational devices are still either generally inefficient due to the fact that they are being designed generally similar to prior art swimming aids and like floats or because they are overly complex. In the latter category a number of said floats are available which generally resemble a single occupant type sailing boat. Because of the complexity in structure which is somewhat common to the vast majority of these prior art devices, their initial expense, trouble and cost of operation and maintenance and inefficiency of performance have rendered a large portion of these devices unattractive to the public at large.

Accordingly, it can be seen that there is a need for a recreational and commercial device readily adaptable for rescue efforts, recreational or other activies on a liquid such as water. Such a device should be initially inexpensive to obtain and manufacture and simple to operate and maintain by the user of such a device.

It is also desirable to provide an inflatable or pneumatic aquatic device including telescopic rigid members for collapsing the unit for efficient transportation of the aquatic device. A small size of transfer is important not only from military considerations of the inflatable aquatic device but also in view of the reduction in size of present day automobiles.

Therefore it is an object of this invention to provide an inflatable aquatic device having plural aquatic members each having gas chamber means therein for containing a gas and providing buoyancy.

Another object of this invention is to provide an inflatable aquatic device wherein each of the plural aquatic members includes a substantially rigid frame having a plate region and a plurality of support means extending relative to the, plate region wherein the plurality of support means may be varied in length to facilitate transporting the inflatable aquatic device.

Another object of this invention is to provide an inflatable aquatic device having a plurality of flexible gas chamber means and a substantially rigid frame structure with fabric means adapted to encompass the flexible gas chamber means for securing the substantially rigid frame to the flexible gas chamber means.

Another object of this invention is to provide an inflatable aquatic device comprising plural aquatic members each having a plurality of flexible gas chamber means secured to rigid frame members attachable to an operator's feet for providing a substantially rigid support of the operator through the buoyancy of the flexible gas chamber means.

Other objects will become apparent from the summary of the invention, the description of the preferred embodiment and the appended drawings.

SUMMARY OF THE INVENTION

This invention relates to an aquatic device suitable for industrial and recreational uses as well as rescue efforts. More specifically, the device comprises a pair of floatation means each configured as a pontoon-like element to support the operator on a liquid, such as water, and a pair of paddles specifically configured for use with the pontoon-like elements.

More particularly the invention relates to an inflatable aquatic device comprising plural aquatic members each having a plurality of flexible gas chamber means for containing a gas to provide buoyancy for an operator. Each of the plurality of aquatic members may include a rigid frame having a plate region and a plurality of support means extending relative to the plate region. The rigid frame is secured to the flexible gas chamber means for establishing plural substantially rigid aquatic members for supporting each foot of the operator to stand on the respective plural aquatic members. The plural aquatic members may be interconnected to allow only limited relative movement therebetween.

More particularly the plurality of gas chamber means may comprise a plurality of gas chamber tubes secured adjacent one another forming a generally rectangular buoyant member. Additional gas chambers may be secured to the generally rectangular buoyant member to provide a generally elliptical buoyant member which in many cases is the preferred geometry. A fabric material may be adapted for encompassing the flexible gas chamber means to add protection to the gas chambers. The fabric material may have a plurality of fabric apertures or fabric tunnels extending along the fabric material for receiving telescoping tubing members of the support means to provide a substantially rigid aquatic member through a plurality of flexible gas chamber means providing the required buoyancy.

The plurality of support means may include plural telescoping tubing members with spacer means spacing the plural tubing members relative to one another. The plural telescoping tubing may be secured to the plate region forming a substantially rigid frame member.

Other objects and a fuller understanding of the invention may be had by reference to the detailed description taken in conjunction with the appended drawings and claims.

BRIEF DESCRIPTION OF THE DRAWINGS

FIG. 1 is a top elevational view of the preferred embodiment of the instant invention illustrating plural pneumatic aquatic members;

FIG. 2 is an end elevational view of the devices shown in FIG. 1;

FIG. 3 is a side elevation view of the device shown in FIG. 1;

FIG. 4 is a view along line 4—4 of FIG. 2;

FIG. 5 is a sectional view along line 5—5 of FIG. 4;

FIG. 6 is a top elevational view of fabric material shown as the cover for the pneumatic aquatic members of FIG. 1;

FIG. 7 is an elevational top view of flexible gas chamber means of FIG. 1 which is encompassed by the fabric material of FIG. 6;

FIG. 8 is a sectional view along line 8—8 of the pneumatic gas chamber means shown in FIG. 7;

FIG. 9 is a sectional view along line 9—9 shown in FIG. 7;

FIG. 10 is a top elevational view of a variation of invention shown in FIG. 1;

FIG. 11 is a side elevational view of the invention shown in FIG. 10; and

FIG. 12 is an elevational partial view of a paddle suitable for use with the aquatic devices disclosed.

DETAILED DESCRIPTION

Similar reference characters refer to similar parts throughout the Figures wherein FIGS. 1-9 illustrate a first species of an inflatable aquatic device 10 comprising a first and a second aquatic member 11 and 12 each being substantially identical to one another and each having a plurality of flexible gas chamber means 14 shown in greater detail in FIGS. 7-9. The gas chamber means 14 may comprise a plurality of gas chamber tubes 16-19 which may be made of a flexible material such as nylon, canvas or the like impregnated with a plastic or rubber material for creating gas tight tubes. The gas chamber tubes 16-19 may be innerconnected, at locations 16A-18A as is well known in the art forming a generally rectangular buoyant member. Each of the gas chamber tubes 16-19 may be isolated from one another with each tube having a separate gas valve. In this embodiment gas chamber tubes 16-19 are innerconnected by means (not shown) with a single gas chamber valve 21 shown in greater detail in FIG. 9, provided for inflating and deflating the gas chamber tubes 16-19. In this embodiment, additional gas chambers 24-33 are secured to gas chamber tubes 16-19 to provide a substantially elliptically shaped buoyant member. Gas chamber valves 35 and 36 provide access to gas chambers 24 and 29 respectively whereas gas chamber valves 37 and 38 provide access to gas chambers 25, 26, 27, 28 and gas chambers 30, 31, 32, 33, respectively. The addition of separate gas chamber members and gas chamber valves enables the chambers to be independently inflated enabling alteration of the size and shape of the pneumatic members 11 and 12 in accordance with the application.

The first and second aquatic members 11 and 12 include identical substantially rigid frames 41 and 42 respectively having plate regions 43 and 44 and a plurality of support means 51A-D and 52A-D respectively.

FIG. 4 is a view along line 4—4 of the frame whereas FIG. 5 is a sectional view along line 5—5 of FIG. 4 showing in greater detail the relationship of the plate region 43 and the support means 51A-51D. The plate region 43 includes spacers 55 and 56 secured to the underside of the plate region 43. The support means 51A-51D are spaced relative to one another by the spacers 55 and 56 and secured by bands 61 and 62 for the first aquatic member 11 with similar bands 63 and 64 for the second aquatic member 12. The bands may be made of an elastic material for detachably securing the support means to the plate region.

The support means 51 has been shown as telescopic tubing with lock nuts 68A-68B securing the position of telescoping portions 71A-71D of support members 51A-51D relative to a fixed portions 70A-70B. Conventional thumb screws or the like may also be used for securing the movable portion 71A-71D relative to the fixed portion 70A-70D. The movable portion 71A-71D may be retracted within the fixed portions 70A-70D for reducing the size of the device to the dimensions of the plate region 43. Similar devices may be installed on the other support means 52A-52D.

FIG. 6 is a top elevational view of a fabric material or covering 80 for encompassing the flexible gas chamber means 14 and for securing the rigid frames 41 and 42 to the flexible gas chamber means 14. The coverings 81 and 82 of the first and second aquatic members 11 and 12 in FIG. 1 are identical to the fabric covering 80 in FIG. 6. The fabric includes four apertures 80A, 80B, 80C and 80D communicating with fabric tubes 84A-84D for receiving the support means 51A-51D and 52A-52D as shown in FIG. 1.

The fabric covering includes an aperture 85 for inserting the flexible gas chamber means 14 therethrough. After the device is assembled, the aperture 85 will be located below the plate region 43 as shown in FIG. 1.

Elastic belts 91 and 92 secure the first aquatic member 11 to the second aquatic member allowing only limited movement therebetween.

The inflatable aquatic device 10 may be readily assembled by first inflating the flexible gas chamber means 14 shown in FIGS. 7-9 to the desired shape. The flexible gas chamber means is then inserted through aperture 85 in the fabric covering 80. The support means 51A-51D and 52A-52D are then telescoped into the extended position and simultaneously respectively inserted within tunnels 84A-84D for securing the rigid frame 41 and 42 to the inflatable gas chamber means 14. THe operator may be supported with one foot located on each one of plate regions 43 and 44. The combination of flexible buoyant means 14 and rigid frames 41 and 42 prevents the flexible buoyant means 14 from buckling with the operator's weight. The elastic belts 91 and 92 prevent the operator's legs from extending beyond a given limit.

FIGS. 10 and 11 show variations of the embodiment illustrated in FIG. 1-9 including a device 100 having a first and a second member 101 and 102. The gas chamber means are shown inflated to be a substantial rectangular configuration. This embodiment also includes foot straps 105 and 106 located on the plate regions 108 and 109 respectively for securing the operator's feet thereto. A safety harness 110 may be included to prevent the operator's ankle 111 from being displaced from the pontoon 102.

FIG. 12 illustrates an improved paddle handle for operation with the pneumatic devices set forth herein. The paddle includes a handle 120 having a mounting 122 attached to a flexible connector 124 which is secured to a wrist band 126 securable to an operator's wrist 128. Of course it is understood that the pneumatic device may be operated with various types of paddle devices for providing control and locomotion to the inflatable aquatic device.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

Now that the invention has been described:

What is claimed is:

1. An inflatable aquatic device; comprising in combination:

plural aquatic members each having a plurality of flexible gas chamber means for containing a gas to provide buoyancy;

each of said plural aquatic members including a rigid frame having a plate region and a plurality of support means extending relative to said plate region;

means for securing said rigid frame to said flexible gas chamber means establishing plural substantially rigid aquatic members;

said means for securing said rigid frame to said flexible gas chamber means including a covering material adapted to substantially encompass said flexible gas chamber means;

said covering material having a plurality of covering formed apertures for receiving said plurality of support means extending relative to said plate means; and connecting means for interconnecting said plural aquatic members to allow only limited relative movement therebetween.

2. A device as set forth in claim 1, wherein said plurality of flexible gas chambers comprise a plurality of gas chamber tubes secured adjacent one another forming a generally rectangular buoyant member.

3. A device as set forth in claim 1, wherein said plurality of flexible gas chamber means form a generally elliptical buoyant member.

4. A device as set forth in claim 1, wherein said support means includes means for varying the length of said support means.

5. A device as set forth in claim 1, wherein said plate region is substantially centrally located relative to said gas chamber means.

6. A device as set forth in claim 1, wherein said plurality of support means includes plural telescoping tubing members;

spacer means spacing said plural telescoping tubing members relative to one another: and means for securing said plural telescoping tubing members to said plate region.

7. A device as set forth in claim 1, wherein said means for interconnecting said plural aquatic members includes elastic means.

8. An inflatable aquatic device; comprising in combination:

plural aquatic members each having a plurality of flexible gas chamber means for containing a gas to provide buoyancy;

each of said plural aquatic members including a rigid frame having a plate region and a plurality of support means extending relative to said plate region;

said plurality of support means including plural telescoping tubing members;

spacer means spacing said plural telescoping tubing members relative to one another;

means for securing said plural telescoping tubing members to said plate region;

means for securing said rigid frame to said flexible gas chamber means establishing plural substantially rigid aquatic members, and connecting means for interconnecting said plural aquatic members to allow only limited relative movement therebetween.

9. A device as set forth in claim 8, wherein said means for securing said rigid frame to said flexible gas chamber means includes a fabric material adapted to encompass said flexible gas chamber means;

said fabric material having a plurality of fabric formed apertures for receiving said plurality of support means extending relative to said plate means.

10. A device as set forth in claim 9, wherein said fabric apertures include fabric tunnels extending along said fabric material for receiving said support means.

11. An inflatable aquatic device, comprising in combination:

plural aquatic members each having a plurality of flexible gas chamber means for containing a gas to provide buoyancy;

each of said plural aquatic members including a rigid frame having a plate region and a plurality of support means extending relative to said plate region;

means for securing said rigid frame to said flexible gas chamber means establishing plural substantially rigid aquatic members;

said means for securing said rigid frame to said flexible gas chamber means including a covering material adapted to substantially encompass said flexible gas chamber means;

said covering material having a plurality of covering formed apertures for receiving said plurality of support means extending relative to said plate means;

connecting means for interconnecting said plural aquatic members to allow only limited relative movement therebetween.

plural paddles specifically configured for use in combination with said plural aquatic members, each of said plural paddles comprising a shaft having a blade extending from one end of said paddle and a hand gripping region located at the other end of said paddle; and paddle connector means extending from each of said shafts adapted for engaging the lower arm region of an operator.

12. An inflatable aquatic device; comprising in combination:

plural aquatic members each having a plurality of flexible gas chamber means for containing a gas to provide buoyancy;

each of said plural aquatic members including a rigid frame having a plate region and a plurality of support means extending relative to said plate region;

said plurality of support means including plural telescoping tubing members;

spacer means spacing said plural telescoping tubing members relative to one another;

means for securing said plural telescoping tubing members to said plate region means for securing said rigid frame to said flexible gas chamber means establishing plural substantially rigid aquatic members, connecting means for interconnecting said plural aquatic members to allow only limited relative movement therebetween, plural paddles specifically configured for use in combination with said plural aquatic members, each of said plural paddles comprising a shaft having a blade extending from one end of said paddle and a hand gripping region located at the other end of said paddle; and paddle connector means extending from each of said shafts adapted for engaging the lower arm region of an operator.

* * * * *